United States Patent [19]

Hennessy

[11] Patent Number: 4,524,593

[45] Date of Patent: Jun. 25, 1985

[54] SIDE BAR LOCK WITH ENHANCED PICK RESISTANCE

[75] Inventor: Thomas F. Hennessy, Bristol, Conn.

[73] Assignee: Lori Corporation, Southington, Conn.

[21] Appl. No.: 510,613

[22] Filed: Jul. 5, 1983

Related U.S. Application Data

[63] Continuation-in-part of Ser. No. 231,777, Feb. 15, 1981, Pat. No. 4,404,824.

[51] Int. Cl.[3] ..... E05B 27/06

[52] U.S. Cl. ..... 70/358

[58] Field of Search ..... 70/358, 364 A, 419, 70/364 R, 365, 366, 416, 421

[56] References Cited

U.S. PATENT DOCUMENTS

| | | | |
|---|---|---|---|
| 2,629,249 | 2/1953 | Mendelsohn | 70/419 |
| 4,292,823 | 10/1981 | Reinhord et al. | 70/419 X |
| 4,404,824 | 9/1983 | Hennessy | 70/358 X |

*Primary Examiner*—Richard E. Moore

[57] ABSTRACT

A compact cylinder lock operated by a key having smooth edges and detents in opposed side faces. The locking mechanism includes series connected pin tumblers and side bars which are resiliently biased. A resiliently biased locking bar having locking lugs extending therefrom cooperates with the side bars and lock housing; the locking bar moving out of engagement with the housing and into gates in the side bars when the side bars are moved a sufficient distance by the pin tumblers. The side bars are provided with false gates which engage the lugs on the locking bar to prevent unauthorized opening of the lock.

12 Claims, 6 Drawing Figures

SIDE BAR LOCK WITH ENHANCED PICK RESISTANCE

CROSS-REFERENCE TO RELATED APPLICATION

This application is a continuation-in-part of U.S. application Ser. No. 231,777, now U.S. Pat. No. 4,404,824, issued Sept. 20, 1983, filed Feb. 15, 1981.

BACKGROUND OF THE INVENTION (1) Field of the Invention

The present invention is directed to locks and particularly to side bar type locks. Specifically, the present invention relates to enhancing the pick resistance of the novel lock of U.S. Pat. No. 4,404,824. Accordingly, the general objects of the present invention are to provide novel and improved devices and methods of such character.

(2) Description of the Prior Art

The above-referenced co-pending application discloses a novel lock wherein the locking mechanism includes resiliently biased and series connected pin tumblers and side bar tumblers. A resiliently biased locking bar having lugs extending therefrom cooperates with the side bars and a slot in the lock cylinder or shell; the locking bar being movable out of engagement with the cylinder with the lugs passing into gates in the side bars when the side bars are moved the appropriate distance by the pin tumblers in response to key insertion. These locks have numerous attributes, including reduced size and comparatively modest production cost, when compared to the prior art.

The locks of U.S. Pat. No. 4,404,824 are, as a consequence of their use of the side bar principle, highly pick-resistant. It is, nevertheless, possible for a highly skilled practitioner to defeat these locks. The foregoing is possible even though the side bars, which are operated by the pin tumblers, will typically be provided with false gates in the form of rectangular notches. Such "picking" was possible partly because each side bar had to travel a comparatively considerable distance before falling into a false gate whereupon further movement of the associated pin tumbler would be prevented.

SUMMARY OF THE PRESENT INVENTION

The present invention overcomes the above-discussed disadvantages and other deficiencies of the prior art by enhancing the pick-resistance of a novel side-bar type lock.

A lock in accordance with the present invention has a key plug which is received within a cylinder. A locking bar is slidably mounted within a lateral slot in the key plug. The locking bar has a cam-like protrusion which, in the locked condition, extends into a logintudinal slot provided in the cylinder wall. Engagement of the key plug locking bar protrusion with the cylinder wall slot normally prevents the plug from rotating within the cylinder. The lock of the present invention further incorporates a unique release mechanism which allows the locking bar protrusion to be cammed out of the cylinder wall slot.

The above-mentioned release mechanism utilizes a novel double-tumbler system. The first tumblers of this double-tumbler system consist of flat sliding tumblers, hereinafter referred to as side bars. These side bars are positioned beneath the locking bar and are oriented transversely with respect thereto. The side of the locking bar which faces the side-bar tumblers is provided with extensions or lugs. The upper edge of each side bar is provided with at least one notch which is termed the true gate. This true gate is dimensioned so that it may receive the cooperating lug of the locking bar. The release mechanism incorporates a series of these side bar tumblers which are provided with true gates at differing locations within their upper edges. A pair of springs normally biases the locking bar into engagement with the cylinder wall slot even when all of the lugs and true gates are aligned. By providing the cylinder wall slot with angled walls, rotation of the key plug can cause the locking bar protrusion to be cammed out of the cylinder wall slot and the lugs driven into the true gates against the biasing effect of the springs. Accordingly, when all of the true gates are aligned beneath the lugs of the locking bar, the locking bar may be cammed out of the cylinder wall slot by rotating the key plug within the cylinder thereby unlocking the lock.

In accordance with the present invention, the above-discussed side bar tumblers are slidably mounted within channels provided within the key plug, these channels being transverse to a plane defined by the keyway in the key plug. The sliding motion of each of the side bars is controlled by the interaction between a biasing spring and a pin tumbler. The side bars are each provided, at a first end, with a first transverse extension or arm. At their other ends, the side bars are provided with a second extension or leg which is co-planar with the key plug channels. These co-planar extensions have an angular relationship to the bottom edge of the side bar. The key plug is also provided with a series of holes aligned in two rows on opposite sides thereof. The holes of the upper row are "blind" while the holes of the lower row are open at both ends, the inner ends of the lower holes being in communication with the keyway. The rows of holes on each side of the key plug are not in alignment with each other but have an alternating alignment of upper and lower holes. The two rows of holes on the opposing sides of the key plug are positioned so that one upper hole on one side is partially in alignment with a lower hole on the opposing side. These two partially aligned holes are interconnected by the aforesaid channels which receive the side bars. A side bar tumbler biasing spring is positioned within each of the "blind" holes and a pin tumbler is positioned within each of the lower holes. The first extension of the side bar tumblers are positioned within the upper holes so that the springs are compressed between these first extensions of the side bars and the bottoms of the holes. This biases the first extensions of the side bar out of the key plug holes. The second extensions of the side bar extend into the lower holes and contact first ends of the pin tumblers. The biasing force of the springs is transferred to the pin tumblers through the side bars. This normally biases the pin tumblers into the keyway. The second ends of the pin tumblers, i.e., the ends which project into the keyway, have a conical shape.

Normally, i.e., with the lock in the locked condition, the true gates of the side bar tumblers are not in alignment with the lugs of the locking bar. When a KABA type key, i.e., a key having detents or "bits" formed in one or both side surfaces, is inserted within the keyway the pin tumblers are initially urged outwardly thereby forcing the side bar second extensions against the biasing springs. This action causes the side bars to slide within the channels. When the correct key is properly positioned, the pin tumblers will move inwardly with such their final position being a function of the depth of the key "bits". When all of the pin tumblers have been displaced outwardly the appropriate distance, the true gates of all the side bars are positioned beneath the lugs of the locking bar. The key plug may be then turned to cam the cam-like protrusion of the locking bar from the cylinder wall slot.

The pin tumblers and side bar tumblers are alike for locks of the same size with the key changes being determined by the positioning of the true gates on the upper edges of the side bars. Accordingly, the manufacture of only one size pin tumbler and only one size side bar is required thereby reducing manufacturing difficulties and costs. The locking bar of all locks of the same size are also identical with the lugs arranged in only one position. The true gates may be provided within the side bar tumblers after they are formed. This allows for easy repair of the lock assembly since an old side bar may be aligned with a new side bar and the appropriate true gate cut within the upper edge of the new side bar.

With prior art cylinder locks which utilize pin tumblers, if torsion is applied to the key plug a "ledge" is created at the shear line between the plug and the cylinder or shell. This catches the drivers thus permitting the unauthorized opening of the lock. With the present invention there are no drivers to be caught and no ledges to be formed. Additionally, the side bar tumblers are provided with false gates. These false gates are in the form of saw-tooth cuts in the upper edge of the side bars. The false gate defining cuts are offset from the true gates. There will preferably be at least two of these false gates in each side bar and, space permitting, the false gates will be provided in pairs on at least one side of the true gate. The false gates are positioned before the true gates in the direction of motion of the side bars when a key is inserted in the keyway. Also in accordance with the invention, the bottom edge of the lugs on the locking bar are provided with a V-shaped slot which cooperates with the contour of the side bar upper edges, i.e., the V-shaped groove in the bottom of the locking bar will engage the "land" between a pair of false gates or the "land" between the true gate and the nearest false gate to capture the side bars in a locked position. Application of torsion to the key plug, and resulting slight movement thereof, will cause a lug on the locking bar to immediately fall into a false gate where it is caught. It thus becomes necessary to release the tension on the key plug in order to attempt to defeat the lock. However, release of the torsional force allows the tumblers to return to the unlocked condition where no ledge exists, i.e., the side bars are not hung up. It is thus virtually impossible to locate the position of the true gate and to move the tumblers so as to align the lugs on the locking bar with the true gates.

The present invention has, as one of its objects, the provision of a novel and improved side bar lock which is highly resistant to defeat.

BRIEF DESCRIPTION OF THE DRAWING

The present invention may be better understood and its numerous objects and advantages will become apparent to those skilled in the art by reference to the accompanying drawing, wherein like reference numerals refer to like elements in the several FIGURES, and in which.

DESCRIPTION OF THE PREFERRED EMBODIMENT

Figure 1:
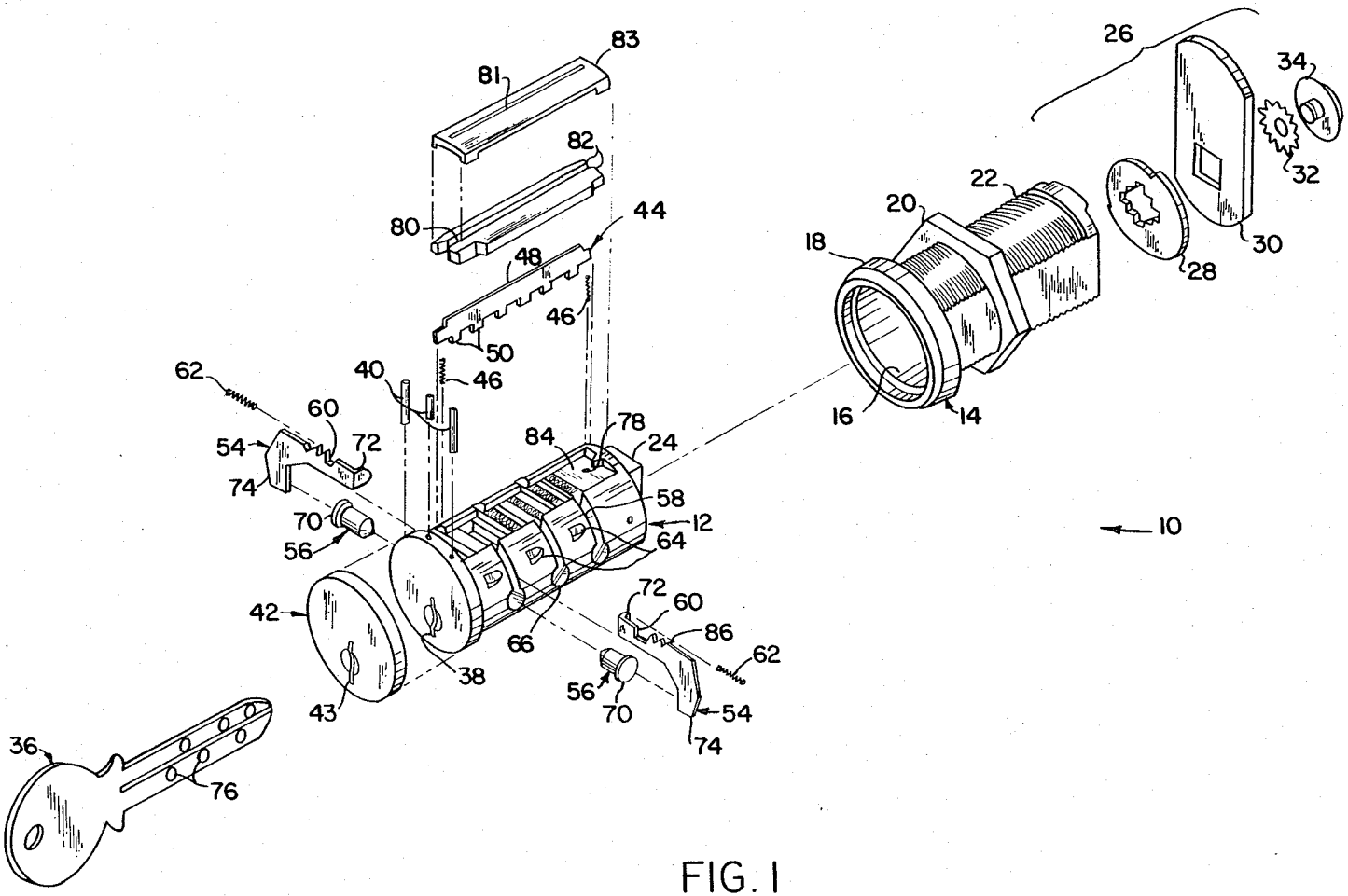
FIG. 1 is an exploded perspective view of the preferred embodiment of a lock in accordance with the present invention with its key.

Referring to FIG. 1 a cylinder lock in accordance with the preferred embodiment of the present invention is generally indicated at 10. Cylinder lock 10 is comprised of a key plug subassembly 12 and a cylinder subassembly 14. Cylinder subassembly 14 defines a bore 16 which receives key plug subassembly 12. The cylinder subassembly 14 includes collar 18 and cylinder nut 20. The construction of cylinder 14 is well-known in the art and it should be understood that while FIG. 1 illustrates the preferred embodiment any type of conventional cylinder arrangement may be employed including mortise type cylinders, rim type cylinders, electric switch type cylinders, automobile ignition lock type cylinders, padlocks, etc.

Key plug 12 is rotatable within bore 16 of cylinder 14. The first end of key plug 12 is provided with stud 24. The second end of the key plug 12 is provided with keyway 38. Keyway 38 is an internal cavity and preferably a lateral slot which is sized to receive key 36. Stud 24 rotates with key plug 12 and may be associated with any conventional mechanism such as, for example, cam assembly 26. Stud 24 may also be associated with other mechanisms such as door bolt retracting mechanisms, auto ignition switches, etc. Cam assembly 26 is comprised of quarter turn washer 28, camming arm 30, lock washer 32 and screw 34. This arrangement is well-known in the art and will not be discussed further herein.

Preferably, the second or forward end of key plug 12 is provided with a plurality of blind holes each of which receives a hardened pin 40. These hardened pins 40 impede the drilling of key plug 12 pursuant to the unauthorized opening of lock 10. It is to be noted that pins 40 are not an essential element of the invention. While hardened pins 40 are preferred, alternate drill impeding structures, a hardened disc for example, may be provided. It is further preferable to cover the second or key receiving end of key plug 12 with a plug cap which is indicated generally at 42. Cap 42 captures the hardened pins 40 within the holes provided therefor in key plug 12. Cap 42 is provided with slot 43 which aligns with keyway 38.

Figure 2:
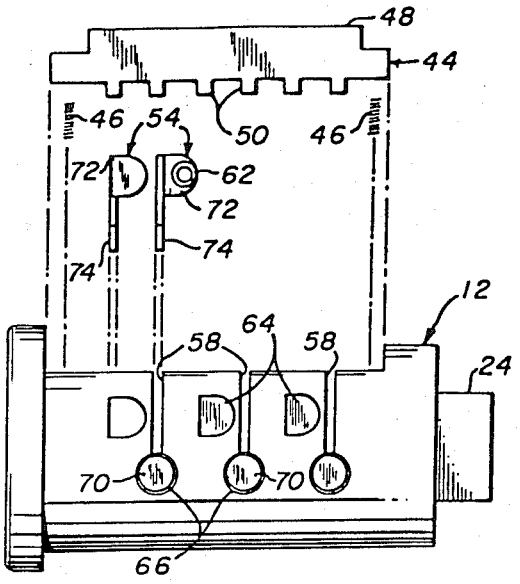
FIG. 2 is an exploded side view of the key plug of the embodiment of FIG. 1.
Figure 4A:
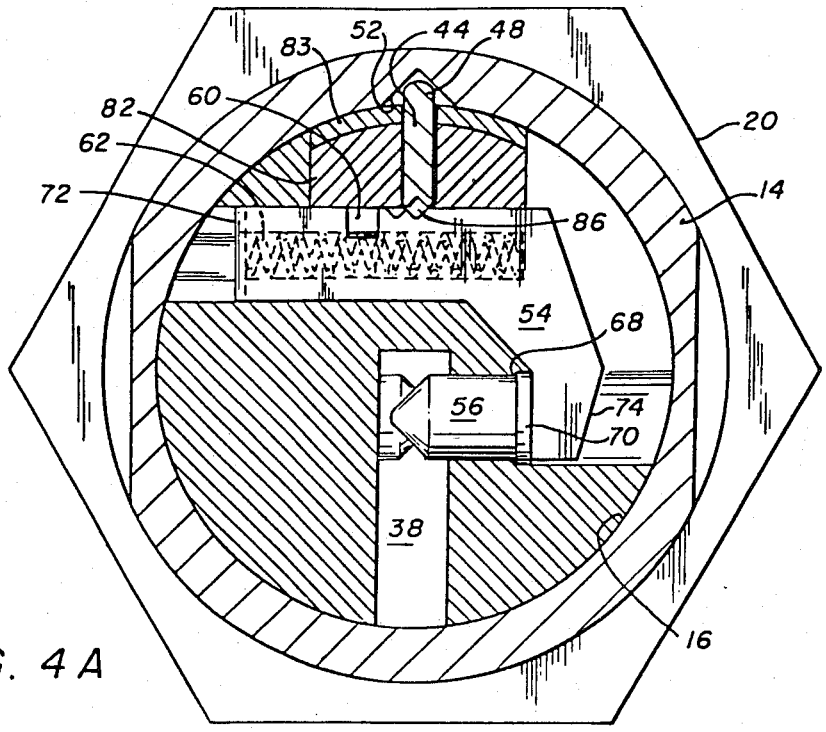
FIGS. 4A and 4B are cross-sectional views of the assembled lock, taken along line 4—4 of FIG. 2, respectively depicting the lock in the locked and unlocked conditions.
Figure 4B:
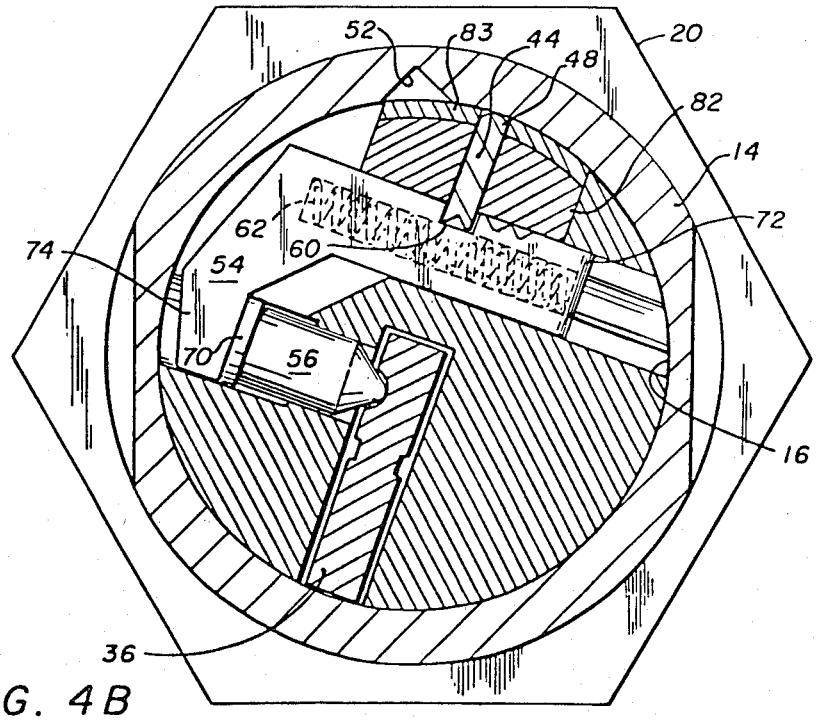

Referring jointly to FIGS. 1 and 2, the key plug 12 of cylinder lock 10 will now be described. Key plug 12 is normally prevented from rotating by a locking mechanism. This locking mechanism is comprised of a locking bar 44 and associated biasing springs 46. Springs 46 are positioned beneath locking bar 44 within blind holes 78 provided within the body of key plug 12. Locking bar 44 is preferably of a generally rectangular shape with a top and bottom edge. Locking bar 44 is slidably mounted within a lateral slot 80. Slot 80 is preferably provided within a support 82 which is distinct from key plug 12. Support 82 is received in a compartment or recess 84 which is provided within key plug 12. Support 82 is covered with retainer plate 83 which prevents the movement of support 82 when key plug 12 is mounted in cylinder bore 16. Plate 83 is affixed to the body of cylinder 12, for example by staking, and is provided with slit 81 which is aligned with lateral slot 80. Support 82 is also preferably constructed in two sections in order to allow easy placement within compartment 84. The upper edge of locking bar 44 is provided with an elongated cam-like extension 48 and the opposite edge of locking bar 44 is provided with a plurality of lugs 50. Cam-like extension 48 is normally received within a generally V-shaped cam notch 52, which may best be seen from FIGS. 4A and 4B, provided within the bore 16 of cylinder 14. Cam-like extension 48 of locking bar 44 has a rounded upper contour as shown and can be disengaged from cam notch 52 by a releasing mechanism which is operated by key 36. Extension 48 may be cammed out of notch 52 against the biasing force of springs 46 by rotating key plug 12 from the position shown in FIG. 4A to that of FIG. 4B after insertion of the proper key in keyway 38.

The releasing mechanism of the present invention is comprised of a dual in-line tumbler system. This tumbler system incorporates cooperating pairs of flat side bar tumblers 54 and pin tumblers 56. Side bar tumblers 54 are slidably mounted beneath locking bar 44, and in a crosswise orientation with respect to locking bar 44, within slots or channels 58 formed in key plug 12. Side bars 54 have first and second oppositely disposed edges and define planes which are generally transverse to the plane defined by locking bar 44. The first edges of side bars 54 face lugs 50 of locking bar 44.

Each of lugs 50 of locking bar 44 are normally spaced from but juxtapositioned to the first edge of a side bar 54. This arrangement, in cooperation with the biasing action of springs 46, prevents cam-like extension 48 of locking bar 44 from being disengaged from cylinder notch 52 if rotational force is applied to key plug 12 when no key or the improper key is inserted in the keyway. The said first edges of side bars 54 are each provided with a true gate 60. True gates 60 are sized so as to be capable of receiving a lug 50. By sliding side bar tumblers 54 within channels 58, true gates 60 may be aligned with lugs 50. The rotation of key plug 12 within cylinder 14, permitted when all of the side bar tumblers 54 are properly positioned, cams extension 48 of locking bar 44 out of notch 52 and forces lugs 50 into true gates 60 by driving locking bar 44 against the biasing force of springs 46.

The locked position of each side bar tumbler 54 within a channel 58 is controlled by a pin tumbler arrangement including a tumbler spring 62 and a pin tumbler 56 which cooperates with key 36. Tumbler springs 62 and pin tumblers 56 are respectively removably mounted within bores 64 and 66 of key plug 12. Spring receiving bores 64 and pin tumbler receiving bores 66 are provided within key plug 12 by any known method, such as by drilling. Bores 64 are blind holes. Pin tumbler receiving bores 66 extend from the exterior of key plug 12 into keyway 38. Pin tumbler bores 66 are further provided with internal shoulders 68, as shown in FIGS. 4A and 4B, which restrict the reciprocating movement of pin tumblers 56 in a first direction by engaging outwardly extending flanges defined by the base of cap portions 70 of pin tumblers 56. In the preferred embodiment of the present invention the spring receiving bores 64 are aligned in rows which are offset with respect to pin tumbler bores 66 which are also aligned in rows. These offset rows of spring bores 64 and pin tumbler bores 66 are provided on opposing sides of key plug 12 whereby the bores 66 intersect the keyway from a pair of opposite directions. Spring receiving bores 64 and pin tumbler bores 66 are also preferably arranged on each side of key plug 12 in a zigzag fashion which may best be seen from FIG. 2. This arrangement partially aligns each spring receiving bore 64 with a pin tumbler bore 66 on the opposite side of key plug 12. These partially aligned holes are interconnected by the channels 58 in which the side bars 54 move.

Side bars 54 are provided, at first ends, with extension arms 72 which project laterally into spring receiving bores 64. Side bars 54, at their opposite ends, have projections 74 which are received in pin tumbler bores 66. Arms 72 are biased in the outward direction with respect to plug 12 by tumbler springs 62 and thus projections 74 are biased in the inward direction. Projections 74 preferably lie within the same plane as the side bars 54 with which they are integral and projections 74 are angularly related to the body of side bars 54 as clearly shown in FIGS. 4A and 4B. A first side of each of projections 74 contacts a cap portion 70 of the pin tumbler 56 with which it cooperates. The biasing force of tumbler spring 62 upon arm 72 of a side bar 54 normally causes projection 74 to urge its associated pin tumbler 56 into a pin tumbler receiving bore 66 until the flange at the base of the pin tumbler cap 70 engages a shoulder 68. Thus, the tips of pin tumblers 56 are spring biased into keyway 38. Preferably, the tips of pin tumblers 56 have a conical shape.

Figure 3:
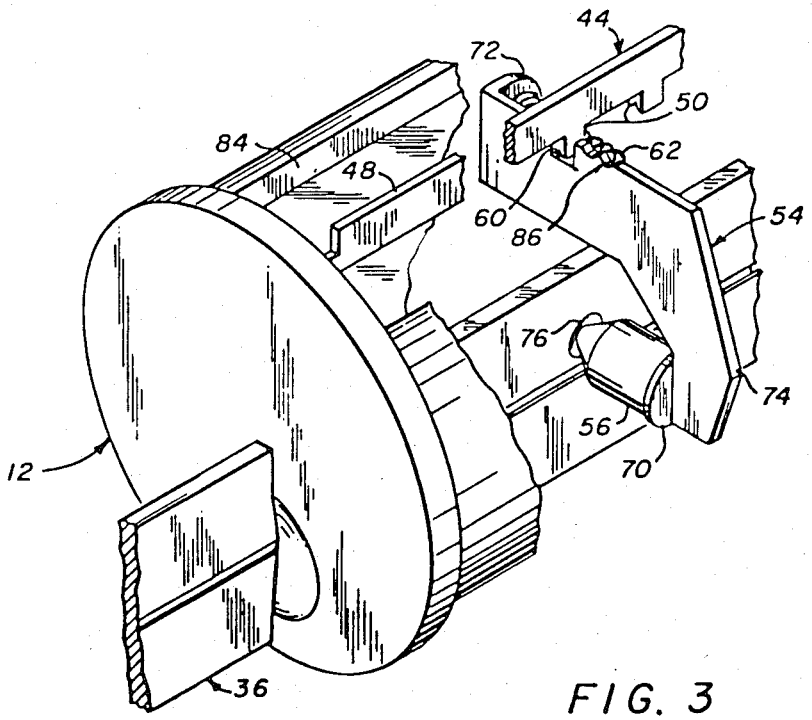
FIG. 3 is a partial perspective and enlarged view of the key plug of the lock of FIGS. 1 and 2 with portions being broken away to expose the side bar tumbler and pin tumbler arrangement beneath the locking bar.

Referring to FIGS. 3, 4A and 4B, the usual operation of cylinder lock 10 will now be described. In the normal or locked state of the lock, depicted in FIG. 4A, the cam-like extension 48 of locking bar 44 is positioned within cam notch 52 of cylinder 14. Cam-like extension 48 is prevented from disengaging cam notch 52, i.e., the locking bar 44 is prevented from moving toward the axis of the lock, by the side bars 54. Lock 10 is operated by the insertion of key 36 into keyway 38. Key 36 is provided on its opposing surfaces with cylindrical or conical detents 76, hereinafter referred to as bits, as shown. The bits 76 are sized, shaped and positioned to receive the tips of pin tumblers 56. The depth of each bit 76 is such that, when the cooperating pin tumbler 56 moves into the bit under the influence of its biasing spring 62, the corresponding side bar 54 will move within a channel 58 to the position where the true gate 60 of the side bar will be aligned with a lug 50 on locking bar 44. By providing key 36 with the proper number and dimensioned conical detents 76 in the proper position, each pin tumbler 56 within key plug 12 will be moved sufficiently to align all of the true gates 60 with lugs 50. At this time, by turning key 36, cam-like extension 48 may be cammed out of cam notch 52 as illustrated in FIG. 4B. Springs 46 retain cam-like extension 48 within cam notch 52 until key plug 12 is rotated within cylinder 14.

Figure 5:
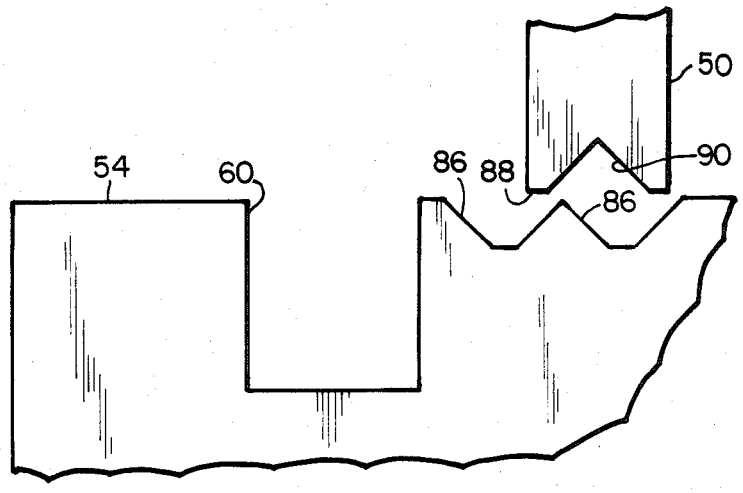
FIG. 5 is an enlarged cross-sectional view of a portion of a locking bar in accordance with the present invention, FIG. 5 also showing a portion of a cooperating side bar tumbler in side elevation.

While the above-described lock is inherently pick-resistant, it can nevertheless be defeated by one highly skilled in unauthorized entry. Thus, in order to render lock 10 virtually immune to picking, the outer edges of the side bars 54, i.e., the edges which have the true gates 60 formed therein, are provided with at least two false gates. These false gates, indicated at 86 on FIG. 5, are positioned such that at least one is located ahead, in the direction of motion of the side bars relative to the locking bar upon application of torsional force to the key plug, of the true gates 60. Additionally, the lugs 50 are provided with V-shaped notches 90. As may best be seen from FIG. 5, the false gates have converging walls and, preferably, a flat bottom which matches the flat edge portions 88 of the lugs 50 of locking bar 44 located to either side of the V-shaped notches 90. The application of torsion to the key plug, in an effort to frictionally capture the locking bar in the raised position while the tumblers are positioned to bring all the true gates into alignment, will produce a downward force on the locking bar and slight movement of the side bars relative to the locking bar. Because of the unique cooperating relationship between the V-shaped grooves 90 in the lugs 50 and the sawtooth shaped false gates 86 in the side bars, the slight relative motion and accompanying downward force will cause the locking bar to immediately fall into the false gates and further motion of the side bars will be prevented. The false gates are of insufficient depth to permit disengagement of the locking bar from the cylinder slot. If the torsional force is relaxed, as would be customary in an effort to pick the lock, the locking bar will immediately return to its initial position. This unique arrangement of cooperating V-shaped locking bar notches and sawtooth shaped false gates also tends to prevent key interchanges, i.e., precisely the correct key must be employed to open the lock. A key with only one incorrect bit will not operate the lock.

If it is desired to remove the key at various locations, the cylinder 14 will be provided with additional V-grooves at the desired locations. This key removal ability, particularly in combination with the small size of the lock, makes it particularly well-suited for use as a switch lock.

Locks in accordance with the present invention are of reduced size, when compared to the prior art, partly because the entire locking mechanism is contained within the key plug. This feature also permits this lock to be substituted for presently available cam-locks, switch locks, auto ignition locks, key-in-knob locks, etc.

The present locks, as noted above, require few parts which can be produced at minimum expense. This results in a lock which can be manufactured at a comparatively low cost.

While a preferred embodiment has been described and illustrated various modifictions and substitutions may be made thereto without departing from the spirit and scope of the invention. Accordingly, it is to be understood that the present invention has been described by way of illustration and not limitation.

What is claimed is:

1. A lock which is operated by a key having at least a first detent provided a surface thereof comprising:

housing means;

key plug means rotatably mounted within said housing means, said key plug means being provided with a keyway;

at least first pin tumbler means, said pin tumbler means being reciprocally mounted in said key plug means and having a pin portion which is partly complementary in size and shape to the key detent, said pin tumbler means normally extending into said keyway, said pin tumbler means being directed out of said keyway upon contact with the detented key, said pin tumbler means unlocked position being determined by engagement of the pin portion thereof with the key detent;

at least first side bar means, said side bar means being slidably mounted in said key plug means, said side bar means being in contact with said pin tumbler means, said side bar means being moved in a first direction by said pin tumbler means when said pin tumbler means engages the detented key, said side bar means having a first edge portion;

first biasing means for resiliently biasing said side bar means in a second direction opposite to first direction, the action of said first biasing means being transmitted to said pin tumbler means via said side bar means;

locking bar means, said locking bar means being reciprocally mounted in said key plug means, said locking bar means being resiliently biased in a third direction generally transverse to said first direction to engage said housing means and prevent the rotation of said key plug means, a first portion of said locking bar means being juxtapositioned to said first edge portion of said side bar means when the lock is in the locked condition whereby the application of rotational force to said key plug means will establish contact between said locking bar means first portion and said side bar means thereby preventing said locking bar means from moving in a fourth direction opposite to said third direction to disengage said locking bar means from said housing means;

true gate means, said true gate means being provided in said side bar means first edge portion, said true gate means being placed in alignment with said locking bar means first portion when said side bar means is moved to the unlocked position by engagement of said pin plug means in a key detent of proper size and depth, said true gate means being sized and shaped to receive said locking bar means first portion to thereby allow said locking bar means to move in said fourth direction and disengage from said housing means;

false gate means, said false gate means being provided in said side bar means first edge portion, said false gate means being at least in part located to the side of said true gate means which is between said true gate means and a point on said side bar means first edge portion which is aligned with said locking bar means with the lock in the locked condition, said false gate means including at least a first cut-out in said side bar means first edge portion, said first cut-out having side walls which are convergent toward the bottom thereof, and second biasing means for resiliently biasing said locking bar means in said third direction.

2. The lock of claim 1 wherein said locking bar means includes a flat bar and said first portion thereof comprises a projection extending from an edge of said flat bar, said projection having four sides and an end, said end being provided with a surface irregularity which is sized and shaped to be partly engaged in said false gate means.

3. The lock of claim 2 wherein said false gate means comprises at least a pair of substantially identical cut-outs, the depth of said cut-outs being less than the depth of said true gate means, said cut-outs having flat bottoms and inwardly converging side walls.

4. The lock of claim 3 wherein said pair of cut-outs are located in said side bar means first edge portion on the same side of said true gate means and are adjacent to one another, the junction of said false gate means cut-outs defining a generally V-shaped land between the said adjacent cut-outs.

5. The lock of claim 4 wherein said locking bar means projection end surface irregularity comprises a generally V-shaped groove which is complementary to said side bar means V-shaped land.

6. The lock of claim 5 wherein said locking bar means projection end surface has a flat portion disposed to either side of said groove, said flat portions having substantially the same size and shape as said false gate flat bottoms.

7. A lock comprising:

tumbler housing means, said housing means having at least a first groove therein;

plug means, said plug means being positioned within said housing means for rotation relative to said housing means, said plug means being provided with an elongated keyway, said plug means having a plurality of openings therein, some of said openings being oriented transversely with respect to said keyway, at least some of said transverse openings intersecting said keyway, at least a further of said openings being oriented generally parallel to said keyway and intersecting some of said transverse openings;

tumbler means, said tumbler means being reciprocally mounted in at least first of said plug means openings;

side bar means, said side bar means being slidably mounted in at least second of said plug means openings, said side bar means contacting respective of said tumbler means, said bar means each having a first edge;

first resilient biasing means, said first biasing means being positioned within at least third of said plug means openings and in contact with said plug means and said side bar means, said first biasing means causing said side bar means to slide in a first direction, movement of said side bar means being transmitted to said tumbler means whereby said tumbler means will extend partly into said plug means keyway;

locking bar means, said locking bar means being slidably positioned in an opening in said plug means which is generally parallel to said keyway, a first edge of said locking bar means engaging said housing means first groove to prevent rotation of said plug means when the lock is in the locked condition, said locking bar means in part extending into the said plug means openings in which said side bar means are disposed whereby said locking bar means extending part is juxtapositioned to said side bar means first edges, said locking bar means extending part including lugs which project outwardly from said locking bar means;

true gate means, said true gate means comprising a locking bar means lug receiving notch formed in each of said side bar means first edges, movement of said locking bar means out of engagement with said housing means first groove being permitted by movement of said side bar means to align said true gate means notches with said locking bar means lugs;

second resilient biasing means for urging said locking bar means toward said housing means, said second biasing means being disposed within at least another opening in said plug means; and false gate means, said false gate means comprising at least a first cut-out formed in the said first edge of at least some of said side bar means, the depth of said first cut-outs being less than the depth of said true gate means notches, said cut-outs each having a pair of convergent walls, said false gate means first cut-outs being at least in part positioned between a true gate means notch and the point of alignment of said side bar means and said locking bar means when the lock is in the locked condition.

8. The lock of claim 7 wherein said locking bar means lugs each have four sides and an end, said ends being provided with a surface irregularity which is sized and shaped to be partly engaged in said false gate means.

9. The lock of claim 8 wherein said false gate means each comprise at least a pair of cut-outs, the depth of said cut-outs being less than the depth of the true gate means notches, said cut-outs having flat bottoms and inwardly converging side walls.

10. The lock of claim 9 wherein said cut-outs of at least some of said pairs are located in said side bar means first edge portion on the same side of said true gate means and are adjacent to one another, the junction of said adjacent false gate means cut-outs defining generally V-shaped lands.

11. The lock of claim 10 wherein said locking bar means lug end surface irregularities comprise generally V-shaped grooves which are complementary to said side bar means V-shaped lands.

12. The lock of claim 11 wherein said locking bar means lug end surfaces each have a flat portion disposed to either side of said grooves, said flat portions having substantially the same size and shape as said false gate cut-out flat bottoms.

* * * * *